United States Patent [19]

DeGraff et al.

[11] 4,364,820

[45] Dec. 21, 1982

[54] RECOVERY OF $C_3$+ HYDROCARBON CONVERSION PRODUCTS AND NET EXCESS HYDROGEN IN A CATALYTIC REFORMING PROCESS

[75] Inventors: Richard R. DeGraff, Deerfield; Kenneth D. Peters, Elmhurst, both of Ill.

[73] Assignee: UOP Inc., Des Plaines, Ill.

[21] Appl. No.: 337,191

[22] Filed: Jan. 5, 1982

[51] Int. Cl.[3] ..... C10G 47/00

[52] U.S. Cl. ..... 208/101; 208/102; 208/134

[58] Field of Search ..... 208/101, 102, 134

[56] References Cited

U.S. PATENT DOCUMENTS

| | | | |
|---|---|---|---|
| 3,431,195 | 3/1969 | Storch et al. | 208/101 |
| 3,520,799 | 7/1970 | Forbes | 208/101 |
| 4,019,979 | 4/1977 | Nolley | 208/102 |
| 4,333,818 | 6/1982 | Coste | 208/101 |
| 4,333,819 | 6/1982 | Scheifele | 208/101 |
| 4,333,820 | 6/1982 | Scheifele | 208/101 |

*Primary Examiner*—Curtis R. Davis

*Attorney, Agent, or Firm*—James R. Hoatson, Jr.; Robert W. Welch; William H. Page, II

[57] ABSTRACT

This invention relates to a hydrocarbon conversion process effected in the presence of hydrogen, especially a hydrogen-producing hydrocarbon conversion process. More particularly, this invention relates to the catalytic reforming of a naphtha feedstock, and is especially directed to an improved recovery of the net excess hydrogen, and to an improved recovery of a $C_3$+ normally gaseous hydrocarbon conversion product and a $C_5$+ hydrocarbon conversion product boiling in the gasoline range.

9 Claims, 1 Drawing Figure

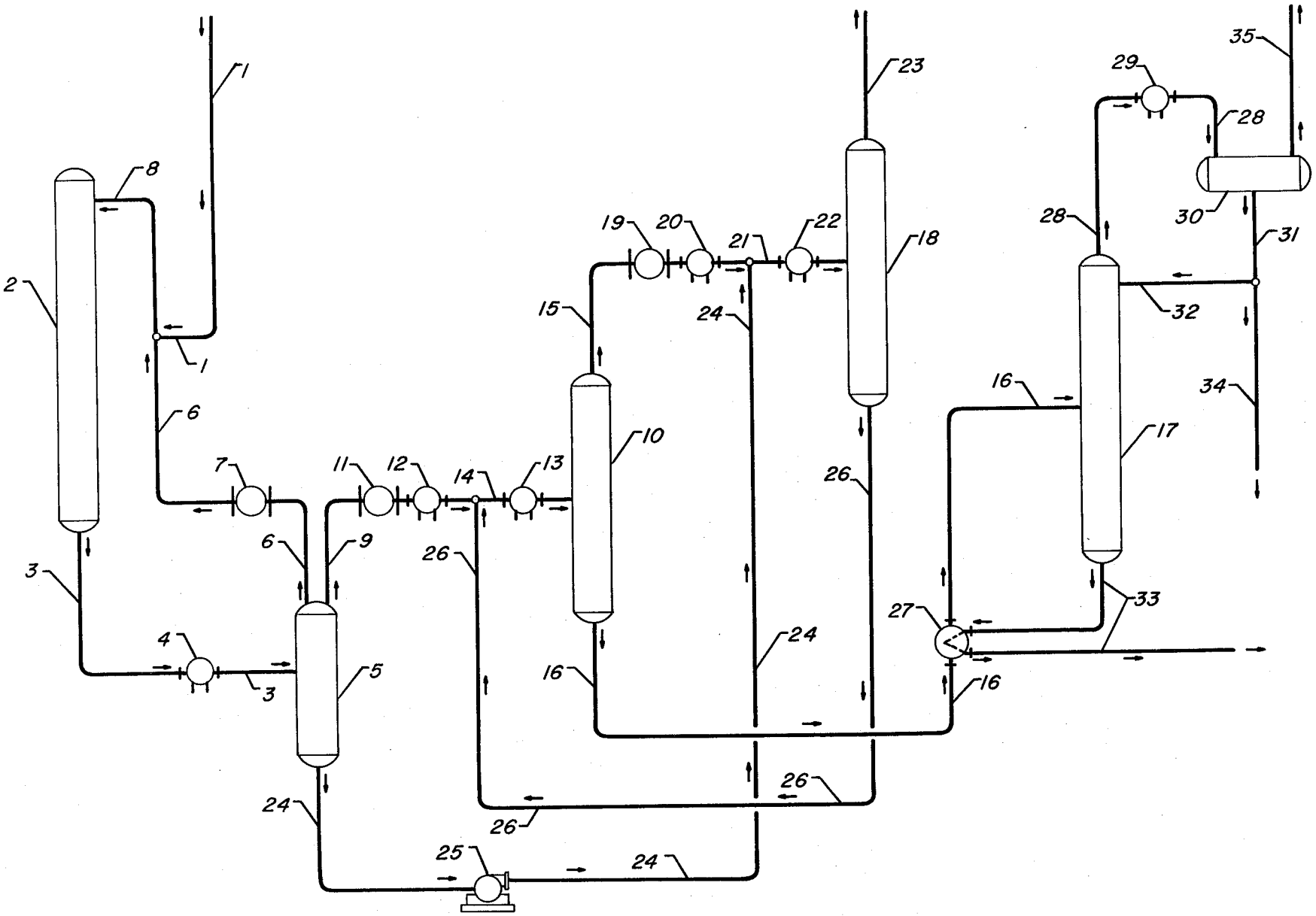
35
28
29
30
31
32
34
28
17
33
16
16
27
23
18
22
21
20
19
26
24
24
26
10
15
16
13
14
12
11
9
5
26
26
25
24
24
1
1
6
7
6
3
4
8
2
3

RECOVERY OF $C_3$+ HYDROCARBON CONVERSION PRODUCTS AND NET EXCESS HYDROGEN IN A CATALYTIC REFORMING PROCESS

This invention relates to a hydrocarbon conversion process effected in the presence of hydrogen, especially a hydrogen-producing hydrocarbon conversion process. More particularly, this invention relates to the catalytic reforming of a naphtha feedstock, and is especially directed to an improved recovery of the net excess hydrogen, and to an improved recovery of a $C_3$+ normally gaseous hydrocarbon conversion product and a $C_5$+ hydrocarbon conversion product boiling in the gasoline range.

It is well known that valuable hydrocarbon conversion products in the gasoline boiling range are produced by the catalytic reforming of a petroleum-derived naphtha fraction. In the catalytic reforming process, the naphtha fraction is typically treated at reforming conditions in contact with a platinum-containing catalyst in the presence of hydrogen, the hydrogen serving to promote catalyst stability.

One of the principal reactions comprising the reforming process involves the dehydrogenation of naphthenic hydrocarbons. While a considerable amount of the resulting hydrogen is required for recycle purposes, for example to maintain a desired hydrogen partial pressure over the reforming catalyst, a substantial net excess of hydrogen is available for other uses, notably the hydrotreating of sulfur-containing petroleum feedstocks.

The separation of hydrogen from the hydrocarbon conversion products of a hydrogen-producing hydrocarbon conversion process is generally effected by cooling the reactor effluent to separate a hydrogen-rich vapor phase and a liquid hydrocarbon phase. The hydrogen-rich vapor phase is subsequently recontacted with at least a portion of the liquid hydrocarbon phase whereby residual hydrocarbons are absorbed from the vapor phase into the liquid hydrocarbon phase. The recontacting process may be repeated one or more times, generally at increasingly higher pressures, to enhance the purity of the hydrogen-rich vapor phase and the recovery of hydrocarbon conversion products. In any case, the liquid hydrocarbon phase is subsequently treated in a fractionation column for the separation of valuable $C_3$+ normally gaseous hydrocarbon conversion products from the $C_5$+ normally liquid hydrocarbon conversion products in the gasoline boiling range. U.S. Pat. No. 3,431,195 is exemplary of the art, and U.S. Pat. No. 3,520,799 discloses a process wherein the hydrogen-rich vapor phase is further treated in a plural stage absorption zone in contact with a bottoms fraction from the aforementioned fractionation column.

The separation of hydrogen from the hydrocarbon conversion products is complicated by the fact that the reforming process also includes a hydrocracking function among the products of which are relatively low boiling hydrocarbons including the normally gaseous hydrocarbons such as methane, ethane, propane, butanes, and the like, a substantial amount of which is recovered with the hydrogen in the phase separation process. While modern catalytic reforming is somewhat more tolerant of these normally gaseous hydrocarbons in the recycle hydrogen, their presence in the net excess hydrogen from the reforming process is frequently objectionable. However, while it is desirable to recover the net excess hydrogen substantially free of said hydrocarbons, it is nevertheless advantageous to maximize the recovery of the less valuable $C_2$− hydrocarbons therein. By so doing, the liquid hydrocarbon phase can be treated in the fractionation column at a lower rate of reflux requiring less refrigeration of the overhead vapors and, consequently, less heat input to the lower section of the column. On the other hand, it is desirable to maximize the recovery of $C_3$+ normally gaseous hydrocarbons to satisfy the demand of other hydrocarbon conversion processes of a refinery complex, and the presence of said hydrocarbons in the net excess hydrogen from the reforming operation represents a loss of valuable feedstock.

It is therefore an object of this invention to present an improved process for maximizing the recovery of hydrogen from the hydrocarbon conversion products of a hydrogen-producing hydrocarbon conversion process.

It is a further object to present an improved process for the separation of hydrogen and $C_2$− hydrocarbons from a hydrocarbon conversion product stream prior to treatment thereof in a fractionation column.

It is a more specific object of this invention to present an improved process for maximizing the recovery of $C_3$+ hydrocarbon conversion products resulting from the catalytic reforming of a naphtha feedstock.

In one of its broad aspects, the present invention embodies a hydrocarbon conversion process comprising the steps of (a) treating a hydrocarbonaceous feedstock in a reaction zone in admixture with hydrogen and in contact with a hydrocarbon conversion catalyst at hydrocarbon conversion conditions of temperature and pressure to provide a reaction zone effluent stream comprising normally liquid and normally gaseous hydrocarbon conversion products admixed with hydrogen; (b) treating said effluent stream in a first gas-liquid separation zone at a reduced temperature effecting the separation of a liquid hydrocarbon phase and a hydrogen-rich vapor phase; (c) recycling a portion of said hydrogen-rich vapor phase to said reaction zone in admixture with said hydrocarbonaceous feedstock; (d) admixing the balance of said vapor phase with a liquid hydrocarbon phase recovered from a third gas-liquid separation zone in accordance with step (f), and treating said mixture in a second gas-liquid separation zone at substantially the same temperature as said first separation zone and at an elevated pressure relative thereto to effect the separation of a liquid hydrocarbon phase having a reduced concentration of hydrogen and $C_2$− hydrocarbons, and a hydrogen-rich vapor phase having a reduced concentration of $C_2$+ hydrocarbons; (e) treating the last mentioned liquid hydrocarbon phase in a fractionation column at conditions to separate an overhead fraction comprising light hydrocarbon conversion products from the higher boiling hydrocarbon conversion products; (f) admixing the hydrogen-rich vapor phase separated in accordance with step (d) with a liquid hydrocarbon phase separated in accordance with step (b), and treating said mixture in a third gas-liquid separation zone at substantially the same temperature as said second separation zone and at an elevated pressure relative thereto to effect the separation of a liquid hydrocarbon phase having a reduced concentration of hydrogen and $C_2$− hydrocarbons, and a hydrogen-rich vapor phase having a reduced concentration of $C_3$+ hydrocarbons; and, (g) recovering said hydrogen-rich vapor phase, and admixing said liquid hydrocarbon phase with the hydrogen-rich vapor phase from step (b) in accordance with step (d).

One of the more specific embodiments of this invention relates to the catalytic reforming of a naphtha feedstock which comprises the steps of (a) treating said feedstock in a reaction zone in admixture with hydrogen and in contact with a reforming catalyst at reforming conditions, including a temperature of from about 600° to about 1000° F. and a pressure of from about 50 to about 250 psig, to provide a reaction zone effluent stream comprising normally liquid and normally gaseous hydrocarbon conversion products admixed with hydrogen; (b) treating said effluent stream in a first gas-liquid separation zone at a temperature of from about 90° to about 110° F. and at a pressure of from about 50 to about 125 psig effecting the separation of a liquid hydrocarbon phase and a hydrogen-rich vapor phase; (c) recycling a portion of said hydrogen-rich vapor phase to said reaction zone in admixture with said naphtha feedstock; (d) admixing the balance of said vapor phase with a liquid hydrocarbon phase recovered from a third gas-liquid separation zone in accordance with step (f), and treating said mixture in a second gas-liquid separation zone at a temperature of from about 90° to about 110° F. and at a pressure of from about 290 to about 350 psig to effect the separation of a liquid hydrocarbon phase having a reduced concentration of hydrogen and $C_2-$ hydrocarbons, and a hydrogen-rich vapor phase having a reduced concentration of $C_3+$ hydrocarbons; (e) treating the last mentioned liquid hydrocarbon phase in a fractionation column at conditions to separate an overhead fraction comprising light hydrocarbon conversion products from the higher boiling hydrocarbon conversion products; (f) admixing the last mentioned hydrogen-rich vapor phase, separated in accordance with step (d), with the liquid hydrocarbon phase separated in accordance with step (b), and treating said mixture in a third gas-liquid separation zone at a temperature of from about 90° to about 110° F. and at a pressure of from about 680 to about 740 psig to effect the separation of a liquid hydrocarbon phase having a reduced concentration of hydrogen and $C_2-$ hydrocarbons, and a hydrogen-rich vapor phase having a reduced concentration of $C_3+$ hydrocarbons; and, (g) recovering said hydrogen-rich vapor phase, and admixing said liquid hydrocarbon phase with the hydrogen-rich vapor phase from step (b) in accordance with step (d).

Other objects and embodiments of this invention will become apparent in the following more detailed specification.

Pursuant to the process of the present invention, a hydrocarbonaceous feedstock is treated in a reaction zone in admixture with hydrogen and in contact with a hydrogen conversion catalyst at hydrocarbon conversion conditions of temperature and pressure to provide a reaction zone effluent stream comprising normally liquid and normally gaseous hydrocarbon conversion products admixed with hydrogen. While the present invention applies to the various hydrocarbon conversion processes effected in the presence of hydrogen, and especially those hydrocarbon conversion processes involving dehydrogenation, the invention is of particular advantage with respect to the catalytic reforming of a naphtha feedstock.

Catalytic reforming is a well-known hydrocarbon conversion process which is widely practiced in the petroleum refining industry. The catalytic reforming art is largely concerned with the treatment of a gasoline boiling range petroleum fraction to improve its anti-knock characteristics. The petroleum fraction may be a full boiling range gasoline fraction having an initial boiling point in the 50°–100° F. range and an end boiling point in the 325°–425° F. range. More frequently, the gasoline fraction will have an initial boiling point in the 150°–250° F. range and an end boiling point in the 350°–425° F. range, this higher boiling fraction being commonly referred to as naphtha. The reforming process is particularly applicable to the treatment of those straight-run gasolines comprising relatively large concentrations of naphthenic and substantially straight chain paraffinic hydrocarbons which are amenable to aromatization through dehydrogenation and/or cyclization. Various other concomitant reactions also occur, such as isomerization and hydrogen transfer, which are beneficial in upgrading the selected gasoline fraction.

Widely accepted catalysts for use in the reforming process typically comprise platinum on an alumina support. These catalysts will generally contain from about 0.05 to about 5 wt.% platinum. More recently, certain promoters or modifiers, such as cobalt, nickel, rhenium, germanium and tin, have been incorporated into the reforming catalyst to enhance the reforming operation.

Catalytic reforming is a vapor phase operation effected at hydrocarbon conversion conditions which include a temperature of from about 500° to about 1050° F., and preferably from about 600° to about 1000° F. Other reforming conditions include a pressure of from about 50 to about 1000 psig, preferably from about 85 to about 350 psig, and a liquid hourly space velocity (defined as liquid volume of fresh charge per volume of catalyst per hour) of from about 0.2 to about 10. The reforming reaction is carried out in the presence of sufficient hydrogen to provide a hydrogen to hydrocarbon mole ratio of from about 0.5:1 to about 10:1.

The catalytic reforming reaction is carried out at the aforementioned reforming conditions in a reaction zone comprising either a fixed or a moving catalyst bed. Usually, the reaction zone will comprise a plurality of catalyst beds, commonly referred to as stages, and the catalyst beds may be stacked and enclosed within a single reactor, or the catalyst beds may each be enclosed at a separate reactor in a side-by-side reactor arrangement. Generally, a reaction zone will comprise 2–4 catalyst beds in either the stacked or side-by-side configuration. The amount of catalyst used in each of the catalyst beds may be varied to compensate for the endothermic heat of reaction in each case. For example, in a three catalyst bed system, the first bed will generally contain from about 10 to about 30 vol.%, the second from about 25 to about 45 vol.%, and the third from about 40 to about 60 vol.%. With respect to a four catalyst bed system, suitable catalyst loadings would be from about 5 to about 15 vol.% in the first bed, from about 15 to about 25 vol.% in the second, from about 25 to about 35 vol.% in the third, and from about 35 to about 50 vol.% in the fourth.

The reforming operation further includes the separation of a hydrogen-rich vapor phase and a liquid hydrocarbon phase from the reaction zone effluent stream. The phase separation is initially accomplished at a pressure which is substantially the same as the reforming pressure allowing for pressure drop through the reactor system, and at substantially reduced temperature relative to the reforming temperature—typically from about 60° to about 120° F. Accordingly, in the present process, the reaction zone effluent stream is treated in a first gas-liquid separation zone at said temperature of from about 60° to about 120° F. and at a pressure of from about 50 to about 150 psig. Preferably, said gas-liquid separation zone is operated at a temperature of from about 90° to about 110° F. and at a pressure of from about 50 to about 125 psig. This initial separation yields a hydrocarbon phase and a hydrogen-rich vapor phase which is generally suitable for recycle purposes.

The vapor-liquid recontacting scheme of the present invention is designed to maximize the recovery of hydrogen in the vapor phase, and to maximize the recovery of $C_3+$ hydrocarbon conversion products in the liquid hydrocarbon phase. Said recontacting scheme, as well as the improvements resulting therefrom, will be more fully appreciated with reference to the attached schematic drawing; however, it is understood that the drawing represents one preferred embodiment of the invention and is not intended as an undue limitation on the generally broad scope of the invention as set out in the appended claims. Miscellaneous hardware such as certain pumps, compressors, condensers, heat exchangers, coolers, valves, instrumentation and controls have been omitted or reduced in number as not essential to a clear understanding of the invention, the utilization of such hardware being well within the purview of one skilled in the art. Referring then to the drawing, there is shown a catalytic reforming zone 2, gas-liquid separation zones 5, 10 and 18, and a stabilizer column 17. In illustration of one preferred embodiment, a petroleum-derived naphtha fraction boiling in the 180°-400° F. range is introduced to the process via line 1 and admixed with a hereinafter described hydrogen recycle stream from line 6. The combined stream is then continued through line 8 and through a heating means, not shown, to enter the catalytic reforming 2 at a temperature of about 1010° F. The catalytic reforming zone will typically comprise a plurality of stacked or side-by-side reactors with provisions for intermediate heating of the reactant stream. The catalytic reforming zone is operated at a relatively low pressure of about 155 psig, said pressure being that imposed at the top of the initial reactor of said catalytic reforming zone 2. A rhenium-promoted platinum-containing catalyst is contained in said reforming zone, and the combined feed, with a hydrogen/hydrocarbon mole ratio of about 4.5, is passed in contact with the catalyst at a liquid hourly space velocity of about 1.

The effluent from the reforming zone 2 is recovered in line 3 and passed through a cooling means 4 into a first gas-liquid separation zone 5 at a temperature of about 100° F. The first separation zone is operated at a pressure of about 105 psig, there being a pressure drop of about 50 psig to the reforming zone 2. The liquid hydrocarbon phase that settles out in said first separation zone comprises about 0.6 mole % hydrogen and $C_1$-$C_2$ hydrocarbons. This liquid hydrocarbon phase is withdrawn through line 24 to be utilized as hereinafter described.

The high severity reforming conditions employed herein promote an increased production of hydrogen in the catalytic reforming zone 2. As a consequence, the hydrogen-rich vapor phase that forms in the first separation zone 5 has a relatively low concentration of hydrocarbons, so much so that the utilities cost associated with their separation exceeds the cost of recycling the same with recycle hydrogen. Thus, one portion of the hydrogen-rich vapor phase, comprising about 94 mole % hydrogen is recovered through an overhead line 6 and recycled to the reforming zone 2. The recycle hydrogen is processed through a recycle compressor 7, admixed with the previously described naphtha feedstock from line 1, and the combined stream enters the reforming zone 2 at the aforesaid pressure of about 155 psig.

The balance of the hydrogen-rich vapor phase is recovered from the first separation zone 5 via line 9 and recontacted with a liquid hydrocarbon phase from line 26, said liquid phase originating from a third gas-liquid separation zone 18 as hereinafter described. The combined stream is th n treated in a second gas-liquid separation zone 10 at an elevated pressure relative to said first separation zone, said pressure promoting the extraction of the higher molecular weight residual hydrocarbons from said vapor phase and the separation of residual hydrogen and lighter $C_1$-$C_2$ hydrocarbons from said liquid phase. As will hereinafter appear, the second separation zone 5 provides the final recontacting of the liquid hydrocarbon phase while the hydrogen-rich vapor phase is subsequently further recontacted in a third gas-liquid separation zone 18. In any case, said second separation zone 10 is preferably operated at a pressure of from about 290 to about 350 psig, although a pressure of from about 275 to about 375 psig is suitable. In the instant case, the second separation zone 10 is operated at approximately 320 psig. The hydrogen-rich vapor phase recovered from the first separation zone 5 by way of line 9 is therefore processed through a compressor means 11 and a cooling means 12 to be combined with the aforementioned liquid hydrocarbon phase from line 26. The combined stream enters the second separation zone by way of line 14, the temperature of said combined stream being reduced to about 100° F. by a cooling means 13.

The liquid hydrocarbon phase that settles out in the second gas-liquid separation zone 10 at the last-mentioned conditions of temperature and pressure is substantially reduced in hydrogen and $C_1$-$C_2$ hydrocarbons which comprise about 1.5 mole % thereof. This liquid hydrocarbon phase is recovered through line 16 and transferred to a stabilizer column 17 for the further separation of normally gaseous and normally liquid hydrocarbon conversion products as described below. The hydrogen-rich vapor phase that forms in the second separation zone 10 comprises about 95 mole % hydrogen. This hydrogen-rich vapor phase is admixed with the previously described liquid hydrocarbon phase recovered from the first separation zone 5, and the mixture is then treated in the aforementioned third separation zone 18 at an elevated pressure relative to said second separation zone 10, and at substantially the same temperature. The third separation zone 18 is preferably operated at a pressure of from about 680 to about 740 psig, although a pressure of from about 675 to about 800 psig is suitably employed. In the present example, the third separation zone is operated at a pressure of approximately 710 psig.

The hydrogen-rich vapor phase is withdrawn from the second separation zone 10 by way of line 15 and passed through a compressor 19 and a cooling means 20 before combining with a liquid hydrocarbon stream from line 24, said liquid hydrocarbon stream originating from the first separation zone 5 and transferred to line 15 by means of a pump 25. The combined stream enters the third separation zone by way of line 21 after a final cooling to about 100° F. by a cooling means 22. The hydrogen-rich vapor phase that forms in the third separation zone represents the net hydrogen product. This vapor phase, comprising about 96 mole % hydrogen, is recovered through an overhead line 23.

The liquid hydrocarbon phase that settles out in the third separation zone 18 would normally be transferred to the stabilizer column 17 for the recovery of the desired $C_3+$ hydrocarbon conversion products. This would normally entail pretreatment of the stabilizer column feed in a flash drum to minimize the reflux requirements of the column and the heating and refrigeration costs attendant therewith. While the flashing process effectively minimizes the $C_2-$ hydrocarbon concentration in the stabilizer feed, it also results in an undue loss of the more valuable $C_3+$ hydrocarbon conversion products. In accordance with the process of the present invention, the liquid hydrocarbon phase from the third separation zone 18 is instead recycled to the second separation zone 10 to effect the separation of the residual hydrogen and $C_2-$ hydrocarbons contained therein. Thus, the liquid hydrocarbon phase is recovered through line 26 and transferred to line 9 to be admixed with the hydrogen-rich vapor phase from the first separation zone 5 and treated in a second separation zone 10 in the manner previously described. The resulting liquid hydrocarbon phase that forms in the second separation zone is reduced to about a 1.5 mole % concentration of hydrogen and $C_2-$ hydrocarbons, and this hydrocarbon phase is withdrawn and transferred to the stabilizer column 17 via line 16 as aforesaid.

The liquid hydrocarbon stream in line 16 is increased in temperature by means of a heat exchanger 27 and introduced into the stabilizer column 17 at a temperature of about 450° F. The stabilizer column is operated at a bottom temperature and pressure of about 582° F. and 265 psig, and a top temperature and pressure of about 175° F. and 260 psig. Overhead vapors are withdrawn through line 28, cooled to about 100° F. by a cooling means 29, and enter an overhead receiver 30. A normally gaseous hydrocarbon product stream is recovered from the receiver 30 via line 31 as condensate, one portion thereof being recycled to the top of the column via line 32 for reflux purposes. The balance of the condensate is recovered through line 34, while the uncondensed vapors are discharged from the receiver via line 35. A normally liquid hydrocarbon product stream is recovered from the bottom of the column through line 33 at a temperature of about 530° F., cooled to about 205° F. in heat exchanger 27, and discharged to storage through a cooling means which is not shown.

The foregoing example is illustrative of the best mode presently contemplated for carrying out the process of this invention. The following data sets forth the composition of certain relevant process streams, the composition having been calculated relative to a proposed commercial design.

| | Line No. | | | | | | | | | | | |
|---|---|---|---|---|---|---|---|---|---|---|---|---|
| | 1 | 3 | 8 | 9 | 15 | 16 | 23 | 24 | 26 | 33 | 34 | 35 |
| Component, lb-mols/hr | | | | | | | | | | | | |
| $H_2$ | 0.0 | 16,768.0 | 11,278.1 | 5,480.0 | 5,511.7 | 28.6 | 5,461.3 | 9.9 | 60.3 | 0.0 | 0.0 | 28.6 |
| $C_1$ | 0.0 | 346.7 | 232.2 | 112.8 | 117.3 | 4.9 | 109.6 | 1.7 | 9.4 | 0.0 | 0.0 | 4.8 |
| $C_2$ | 0.0 | 168.4 | 110.9 | 53.9 | 60.2 | 11.5 | 46.1 | 3.7 | 17.8 | 0.0 | 0.3 | 11.2 |
| $C_3$ | 0.0 | 144.2 | 89.6 | 43.5 | 44.6 | 31.0 | 23.6 | 11.1 | 32.1 | 0.0 | 2.0 | 29.0 |
| $iC_4$ | 0.0 | 45.9 | 25.7 | 12.5 | 9.7 | 16.0 | 4.2 | 7.7 | 13.2 | 5.3 | 1.3 | 9.4 |
| $nC_4$ | 0.0 | 63.9 | 33.6 | 16.3 | 11.2 | 25.6 | 4.7 | 14.0 | 20.5 | 23.0 | 0.4 | 2.2 |
| $iC_5$ | 0.0 | 49.2 | 19.6 | 9.5 | 5.0 | 27.4 | 2.2 | 20.1 | 22.8 | 26.5 | 0.3 | 0.7 |
| $nC_5$ | 0.0 | 30.6 | 10.9 | 5.3 | 2.6 | 18.5 | 1.2 | 14.5 | 15.8 | 18.5 | 0.0 | 0.0 |
| $C_6+$ | 2,891.8 | 2,962.6 | 3,083.7 | 93.2 | 40.3 | 2,750.1 | 20.7 | 2,677.5 | 2,697.2 | 2,750.1 | 0.0 | 0.0 |
| Total | 2,891.8 | 20,579.5 | 14,884.3 | 5,827.0 | 5,802.6 | 2,913.6 | 5,673.6 | 2,760.2 | 2,889.1 | 2,823.4 | 4.3 | 85.9 |
| Lbs/hr | 337,713 | 393,149 | 393,149 | 26,936 | 21,910 | 320,011 | 17,702 | 310,778 | 314,986 | 317,323 | 215 | 2,474 |
| Mol. Wt. | 116.8 | 19.1 | 26.4 | 4.6 | 3.8 | 109.8 | 3.1 | 112.6 | 109.0 | 112.4 | 49.9 | 28.8 |
| B.p.s.d. | 30,000 | — | — | — | — | 26,369 | — | 25,352 | 25,913 | 25,974 | 27.5 | — |
| $10^6$ s.c.f.d. | — | 187.4 | 135.6 | 53.1 | 52.9 | — | 51.7 | — | — | — | — | 0.8 |

We claim as our invention:

1. A hydrocarbon conversion process comprising the steps of:

(a) treating a hydrocarbonaceous feedstock in a reaction zone in admixture with hydrogen and in contact with a hydrocarbon conversion catalyst at hydrocarbon conversion conditions of temperature and pressure to provide a reaction zone effluent stream comprising normally liquid and normally gaseous hydrocarbon conversion products admixed with hydrogen;

(b) treating said effluent stream in a first gas-liquid separation zone at a reduced temperature effecting the separation of a liquid hydrocarbon phase and a hydrogen-rich vapor phase;

(c) recycling a portion of said hydrogen-rich vapor phase to said reaction zone in admixture with said hydrocarbonaceous feedstock;

(d) admixing the balance of said vapor phase with a liquid hydrocarbon phase recovered from a third gas-liquid separation zone in accordance with step (f), and treating said mixture in a second gas-liquid separation zone at substantially the same temperature as said first separation zone and at an elevated pressure relative thereto to effect the separation of a liquid hydrocarbon phase having a reduced concentration of hydrogen and $C_2-$ hydrocarbons, and a hydrogen-rich vapor phase having a reduced concentration of $C_3+$ hydrocarbons;

(e) treating the last mentioned liquid hydrocarbon phase in a fractionation column at conditions to separate an overhead fraction comprising light hydrocarbon conversion products from the higher boiling hydrocarbon conversion products;

(f) admixing the last mentioned hydrogen-rich vapor phase separated in accordance with step (d) with the liquid hydrocarbon phase separated in accordance with step (b), and treating said mixture in a third gas-liquid separation zone at substantially the same temperature as said second separation zone and at an elevated pressure relative thereto to effect the separation of a liquid hydrocarbon phase having a reduced concentration of hydrogen and $C_2-$ hydrocarbons, and a hydrogen-rich vapor phase having a reduced concentration of $C_3+$ hydrocarbons; and, (g) recovering said hydrogen-rich vapor phase, and admixing said liquid hydrocarbon phase with the hydrogen-rich vapor phase from step (b) in accordance with step (d).

2. The process of claim 1 further characterized in that said hydrocarbon conversion process is a catalytic reforming process wherein a naphtha feedstock is treated in a reaction zone in admixture with hydrogen and in contact with a reforming catalyst at reforming conditions including a temperature of from about 500° to about 1050° F. and a pressure of from about 50 to about 1200 psig.

3. The process of claim 1 further characterized in that said hydrocarbon conversion process is a catalytic reforming process wherein a naphtha feedstock is treated in a reaction zone in admixture with hydrogen and in contact with a reforming catalyst at reforming conditions including a temperature of from about 600° to about 1000° F. and a pressure of from about 50 to about 250 psig.

4. The process of claim 1 further characterized with respect to step (b) in that said first gas-liquid separation zone is operated at a temperature of from about 75° to about 125° F. and at a pressure of from about 50 to about 150 psig.

5. The process of claim 1 further characterized with respect to step (b) in that said first gas-liquid separation zone is operated at a temperature of from about 90° to about 110° F. and at a pressure of from about 50 to about 125 psig.

6. The process of claim 1 further characterized with respect to step (d) in that said second gas-liquid separation zone is operated at a temperature of from about 75° to about 125° F. and at a pressure of from about 275 to about 375 psig.

7. The process of claim 1 further characterized with respect to step (d) in that said second gas-liquid separation zone is operated at a temperature of from about 90° to about 110° F. and at a pressure of from about 290 to about 350 psig.

8. The process of claim 1 further characterized with respect to step (f) in that said third gas-liquid separation zone is operated at a temperature of from about 75° to about 125° F. and at a pressure of from about 675 to about 800 psig.

9. The process of claim 1 further characterized with respect to step (f) in that said third gas-liquid separation zone is operated at a temperature of from about 90° to about 110° F. and at a pressure of from about 680 to about 740 psig.

* * * * *